US009908129B2

(12) United States Patent
Hummel

(10) Patent No.: US 9,908,129 B2
(45) Date of Patent: Mar. 6, 2018

(54) DISPENSER FOR DISPENSING LIQUID TO PASTY SUBSTANCES

(71) Applicant: MegaPlast GmbH, Villingen-Schwenningen (DE)

(72) Inventor: Karlheinz Hummel, Guetenbach (DE)

(73) Assignee: MegaPlast GmbH, Villingen-Schwenningen (DE)

( * ) Notice: Subject to any disclaimer, the term of this patent is extended or adjusted under 35 U.S.C. 154(b) by 46 days.

(21) Appl. No.: 15/011,869

(22) Filed: Feb. 1, 2016

(65) Prior Publication Data

US 2016/0221016 A1 Aug. 4, 2016

(30) Foreign Application Priority Data

Feb. 2, 2015 (DE) ..... 10 2015 101 445

(51) Int. Cl.
*B05B 11/00* (2006.01)

(52) U.S. Cl.
CPC ..... *B05B 11/3035* (2013.01)

(58) Field of Classification Search
CPC ..... B05B 11/3035
USPC ..... 222/321.7
See application file for complete search history.

(56) References Cited

U.S. PATENT DOCUMENTS 5,306,125 A * 4/1994 Weag ..... B05B 11/0027 222/207
2009/0050651 A1 2/2009 Auer

FOREIGN PATENT DOCUMENTS

DE 20 2005 014 895 U1 8/2006
EP 0340724 A2 * 11/1989 ..... B05B 11/0013

* cited by examiner

*Primary Examiner* — Donnell Long
(74) *Attorney, Agent, or Firm* — Collard & Roe, P.C.

(57) ABSTRACT

To further improve a dispenser of the type in question, in particular with regard to an advantageous production, it is proposed for the support on the inner surface of the cap part to be formed by means of a support section of the support part, which protrudes below the sealing zone and which simultaneously forms an accommodation for the upper free edge of the bellows part in a one-part embodiment with an accommodating section. Provision can thus be made for a one-part embodiment of the support part.

7 Claims, 4 Drawing Sheets

1
2
24
33
29
6
32
17
26
39
38
40
25
27
9
43
18
35
7
10
11
13
8
5
16
3
34
37
36
46
45
42
44
41
48
a
b
43
47
12
30
19
15
23
14
31
20
22
21
4

46
37
25
36
38
39
42
44
40
41
50
18
48
43
47
43
48

25
46
37
36
39
38
42
41
40
18
48
43
47
43
48

50
49
25
α
18
43
49
49
43
47
42

DISPENSER FOR DISPENSING LIQUID TO PASTY SUBSTANCES

CROSS REFERENCE TO RELATED APPLICATIONS

Applicant claims priority under 35 U.S.C. § 119 of German Application No. 10 2015 101 445.9 filed on Feb. 2, 2015, the disclosure of which is incorporated by reference.

The invention relates to a dispenser for dispensing liquid to pasty substances, comprising a pump head, a cap part, which has a dispensing opening, and a pump chamber, which is embodied in the pump head, has a pump chamber wall and has an outlet valve, further comprising a support part, which accommodates the outlet valve, wherein the support part sits in the cap part and is supported on an inner surface of the cap part, wherein the pump chamber is further formed by a bellows part, the upper free edge of which is arranged so as to be assigned to the support part, and wherein the outlet valve rests against the support part in a sealing zone.

Dispensers of the type in question are known. Reference is made, for example, to DE 20 2005 014 895 U1.

A dispenser, in the case of which the support part is embodied in two parts, in particular consisting of a seat part and a counter support part, is known from the aforementioned utility model application. To form the support part, they can be connected to one another, for example by means of a snap-on connection, in particular further by clamping the upper free edge of the bellows part. The support part is supported on the inner surface of the cap part via a length, viewed in the orientation of a longitudinal axis or in the direction of displacement of the cap part, respectively, which corresponds to approximately half of the total length of the support part, viewed in the same direction.

With regard to the known prior art, it is considered to be a technical problem of the invention to further improve a dispenser of the type in question, in particular with regard to an advantageous production.

According to a first idea of the invention, a possible solution of the object is at hand in the case of a dispenser, which focuses on that the support on the inner surface of the cap part is formed by means of a support section of the support part, which protrudes below the sealing zone and which, in a one-part embodiment comprising an accommodating section, simultaneously forms an accommodation for the upper free edge of the bellows part.

Provision can thus be made for a one-part embodiment of the support part. This turns out to be advantageous in particular from a manufacturing point of view.

The support of the support part on the inner surface of the cap part preferably occurs solely in the area of a protruding support section of the support part. In the immediate cooperation area with the inner surface of the cap part, this support section can extend across an axial length, which corresponds to less than half of the total extension length of the support part in axial orientation. The length of the area of the support section, which rests against the inner surface of the cap part, thus preferably corresponds to a third or less, more preferably to a fourth, up to a tenth of the total length of the support part.

The protruding support section can adjoin a cup-like section of the support part. In the case of a dispenser, which is placed onto a plane in operating position, the transition from the cup-like section into the support section or the parting plane resulting hereby between cup section and support section, which is oriented at right angles to the longitudinal axis, respectively, extends below the sealing zone of the outlet valve. The axial distance between this parting plane between cup section and support section and the sealing plane of the outlet valve can corresponds to between a third and two thirds, more preferably to approximately half of the longitudinal extension dimension of the entire support part.

An accommodating section for accommodating the upper free edge of the bellows part is embodied on the support section or adjoining it—thus for example in the area of the cup section. The upper free edge of the bellows part is preferably clamp-mounted here.

Provision is thus preferably made for a one-part support part embodiment, with said support part having the seal seat for the outlet valve as well as the accommodating section for the upper free edge of the bellows part and the support area.

Viewed from the top—that is, viewed from an impact area of the cap part in the direction of displacement of the cap part in response to dispensing a substance—the support section can extend across a third or more of the free pump chamber wall. The support section can thus extend up to four-fifths of the free pump chamber wall; comprehensively covers the pump chamber wall accordingly. This covering is preferably at hand in the initial position of the dispenser as well as in the substance dispensing position of the dispenser, wherein, in the latter case, the pump chamber wall can also be covered completely by the support section.

In any event, the support section is bellmouthed in the lower area, that is, facing the upper free edge of the foot area, which faces away from the bellows part.

Distancing walls, which orient themselves on a radial with regard to a longitudinal axis of the pump chamber, can adjoin on the inner side of the accommodating section. The support part can dip into the pump chamber or into the bellows part, respectively, by means of these distancing walls. The distancing walls can serve to stabilize the bellows part, which can preferably be deformed elastically, in the course of dispensing the substance.

On the inner side, one or a plurality of the distancing walls can transition into an annular structure, which annular structure can accommodate a foot area of the outlet valve. The annular structure can furthermore be a part of the seal seat for the outlet valve.

Preferably, the annular structure serves to axially guide the in particular axially displaceable outlet valve.

Assigned to their lower free ends, one or a plurality of distancing walls can support a closing part, around which the substance is to flow, in particular when dispensing. The closing part can be connected to the above-described annular structure. In the course of dispensing the substance, the substance flows around the closing part, hereby permeating free spaces, which remain in circumferential direction between the distancing walls and more preferably also around the annular structure, so as to escape via the outlet valve, which is open as a result of axial displacement, and via the dispensing opening of the cap part.

The distancing walls can in each case be shaped in a plate-shaped manner, comprising a material thickness, which, viewed in circumferential direction, corresponds to a fraction of the radial extension of the distancing wall. For example, the material thickness thus corresponds to between a tenth and a fifth of the radial extension of the distancing wall, starting at the annular structure.

A distancing wall can also extend radially outside in circumferential direction across an angle of between 20 and 70°. In this case, gap-like passage openings for the substance remain in circumferential direction between two distancing walls.

Radially on the inside, in particular facing the annular structure, the distancing wall can extend across the same angle as radially on the outside.

With regard to the disclosure, the ranges or value ranges, respectively, or multiple ranges specified above and below also include all intermediate values, in particular in 1/10 steps of the respective dimension, if applicable thus also dimensionless. For Example, the designation between 20 and 70° also includes the disclosure of between 20.1 and 70°, between 20 and 69.6°, between 20.1 and 69.9°, between 23.7 and 63.1°, etc. On the one hand, the disclosure can serve to limit a mentioned boundary from the bottom and/or the top, in the alternative or additionally it can serve to disclose one or a plurality of singular values from a respective specified range.

The invention will be explained below by means of the enclosed drawing, which, however, only represents exemplary embodiments. A part, which is explained only based on one of the exemplary embodiments and which, in the case of a further exemplary embodiment, has not been replaced by a different part as a result of the special feature emphasized therein, is thus also described as a part, which might be present as well for this further exemplary embodiment. In the drawing FIG. 1 shows a dispenser in a longitudinal section illustration, relating to a first embodiment of a support part;

Figure 1:
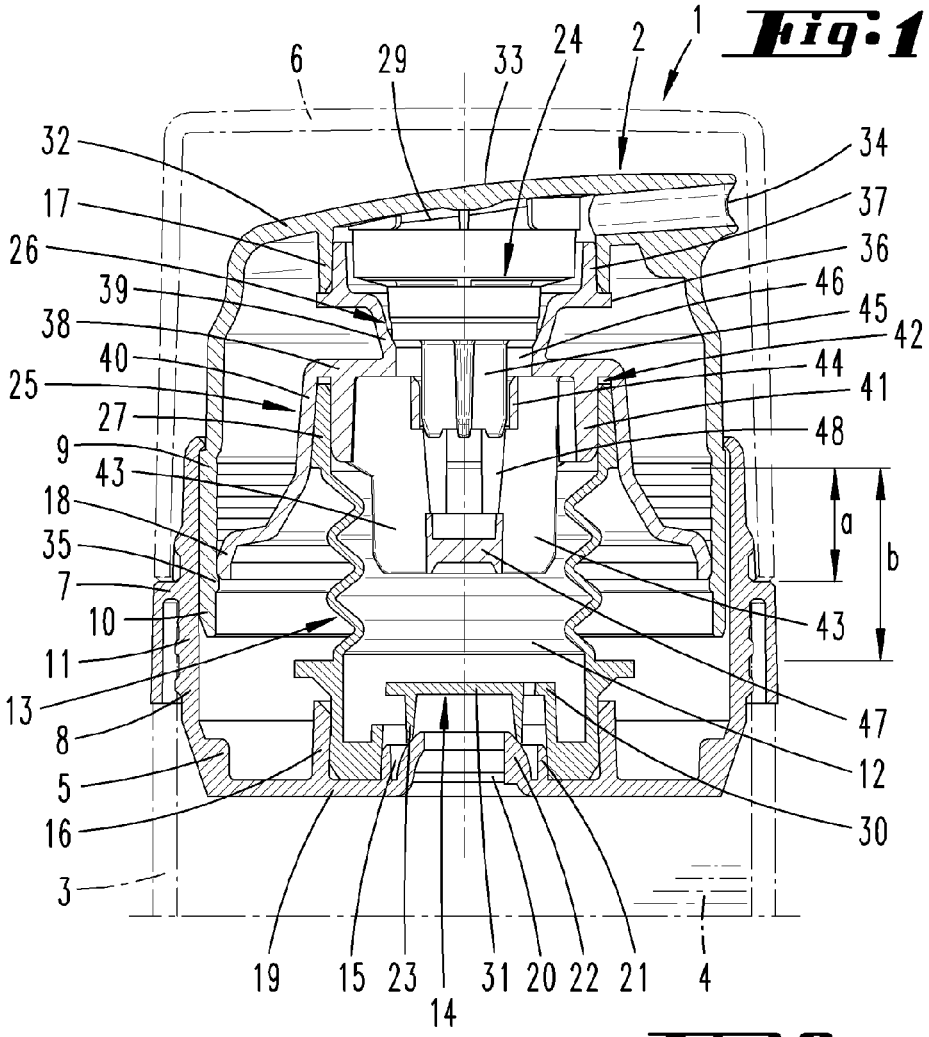
Figure 2:
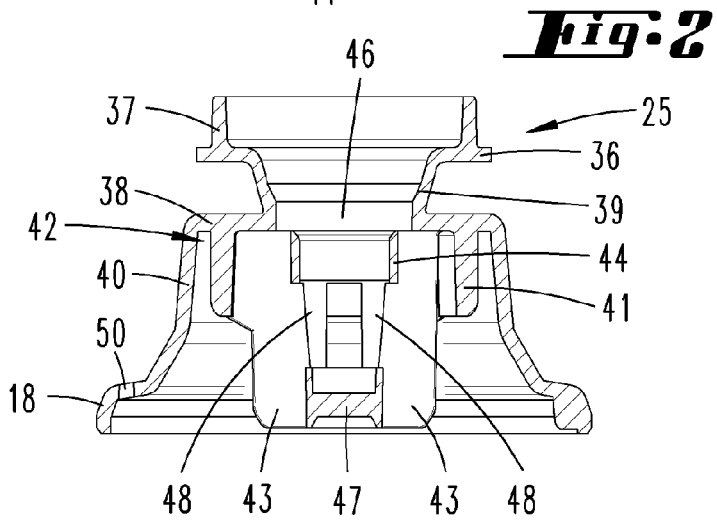
FIG. 2 shows the support part in a longitudinal section individual illustration.
Figure 3:
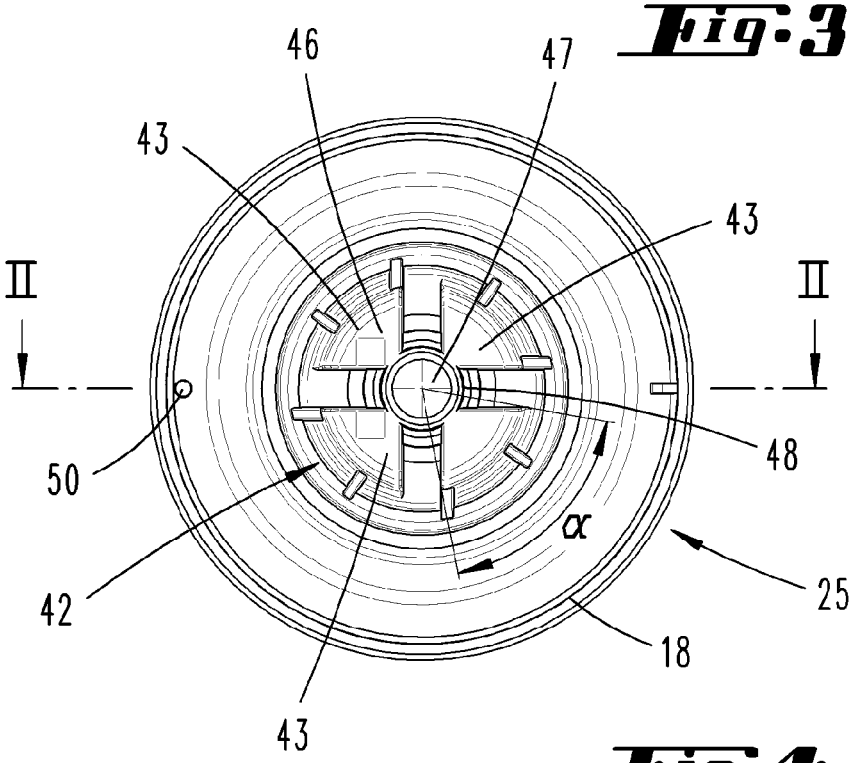
FIG. 3 shows a bottom view of the support part.
Figure 4:
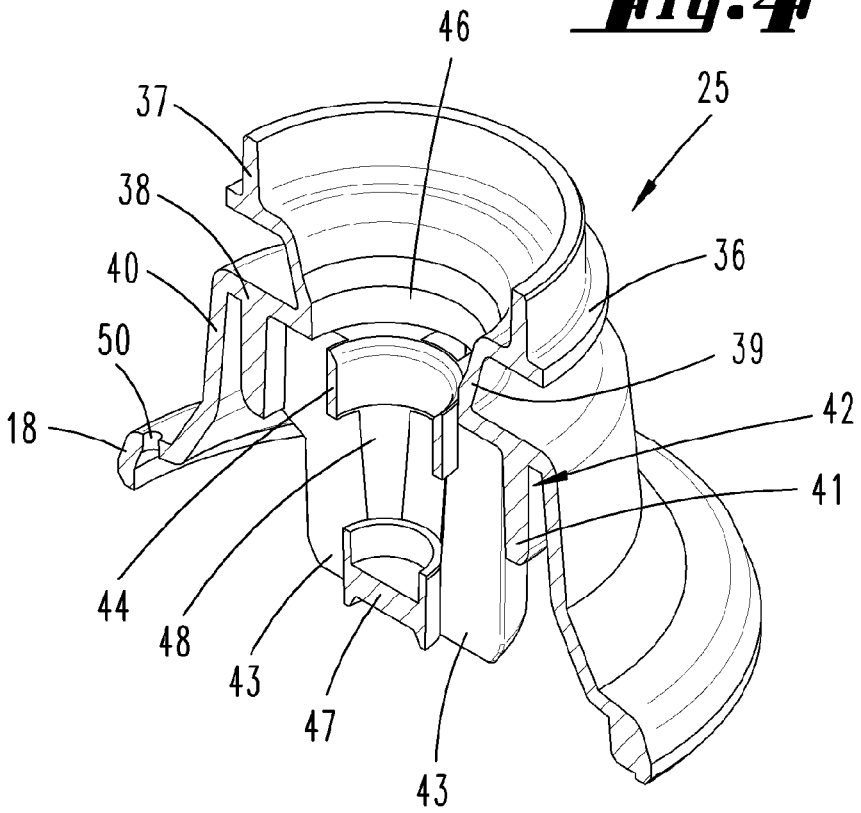
FIG. 4 shows a perspective illustration of the support part in longitudinal section.

Initially with regard to FIG. 1, what is illustrated and described is a dispenser 1, substantially consisting of a pump head 2 and a storage container 3.

The pump head 2 is embodied for dispensing a liquid to pasty substance 4, which is stored in the container 3.

The pump head 2 can be embodied so as to be modular and can be inserted into the storage container 3 from the top.

The connection between the storage container 3 and the pump head 2 is attained by means of an adapter part 5.

The adapter part 5 is substantially formed in a cup-like manner, comprising a cup opening, which faces upwards for accommodating the pump head 2.

The outer cup wall of the adapter part 5 is provided with circumferential, preferably ring-like projections or recesses, respectively, for clamp-mounting the storage container 3, and more preferably for clamp-mounting a cap 6, which covers the pump head 2 in the non-use position. The adapter part 5 is preferably supported on the circumferential outer opening edge of the storage container 3 via an annular shoulder 7, which is molded integrally on the outer wall side of the circumferential cup wall.

The adapter part 5 further embodies a telescopic outer part 8 for accommodating the pump head 2, which molds a telescopic inner part 9 accordingly, in a linearly displaceable manner.

The pump head 2 has a cap part 32 comprising an actuating surface 33. The cap part 32 is provided with a telescoping inner wall 10, which preferably revolves concentrically to a longitudinal central axis x of the dispenser 1. Said inner telescopic wall 10 is guided in the adapter part 5 on the inner wall side of the cup wall, which molds the outer telescopic wall 11.

A telescopic linear displacement of the cap part 32 relative to the adapter part 5 is made possible across a maximum displacement path, which corresponds to approximately a third to half of the cup height of the adapter part 5, viewed in longitudinal extension.

The pump head 2 has a pump chamber 12, which consists of a flexible bellows part 13.

The bellows part 13 is embodied so as to run in a zigzag-shaped manner in a central longitudinal cross section according to the illustration in FIG. 1, wherein the longitudinal central axis x is illustrated as a line in the sectional plane. An embodiment of the bellows part 13 in the shape of a circular ring results in a horizontal section, viewed at right angles to this.

Preferably, this is an injection molded plastic part of a corresponding flexible, resilient plastic.

On the side of the foot, an inlet valve 14 is embodied so as to be integrated in the bellows part 13. Said inlet valve is in cooperation with a valve seat 15, which is embodied on the cup bottom side of the adapter part 5.

Cap part 32 and adapter part 5 telescope with one another outside of the bellows part 13.

On the cup bottom side, facing the bellows part 13, the adapter part 5 embodies a support base 16, in which a foot area of the bellows part 13 sits. In this area, the bellows part 13 is no longer embodied in a bellows-like or in a zigzag-shaped manner in longitudinal cross section, respectively, but comprising a massive wall, which has a reinforced triangular cross section in the transition area of the support base 16.

The bottom 19 forms a central opening 20 as supply channel to the inlet valve 14, with said opening 20 being retracted towards the interior of the pump chamber 12 relative to the bottom 19.

On the side of the hole top, the channel tapers off in two concentric rings 21, 22, of which the outer surface of the ring 21 is embodied for cooperating with a valve lip 23 of the bridge-like inlet valve 14 so as to form a seal.

An outlet valve 24, which is formed of a flexible plastic, is located in the pump head 2, substantially above the pump chamber 12. Said outlet valve 24 sits in a support part 25.

In the case of an embodiment of the pump head wall as whole as preferably being circular cylindrical, the support part 25 extends concentrically to the longitudinal central axis x and is supported on one end in the area of the dispensing channel 29 on an annular shoulder 17, which is oriented concentrically to the longitudinal central axis x, and, on the other end, on the inner wall side on the inner telescopic wall 10 of the cap part 32 in the area of a support section 18, which is oriented downwards in the direction of the bottom 19 of the adapter part 5.

Provision is made for a circumferential support projection 35 in the area of the support of the support section 18 on the wall of the cap part 32 on the inner wall side of the cap part 32.

The section of the support part 25, which is supported on the annular shoulder 17, is substantially formed in a cup-like manner, comprising a cup opening, which points upwards in the direction of the dispensing channel 29. The annular shoulder 17 is supported on the bottom 36 of the cup, while the wall 37 of the cup rests against the annular shoulder 17 on the inner wall side.

The bottom 36 preferably extends so as to be oriented at right angles to the longitudinal central axis x.

A cover section 38, which is plane-parallel to the bottom 36, runs at an axial distance thereto on the upper side of the respective end of the bellows part 13. Said cover section 38 has a radial extension, which substantially corresponds to that of the bottom 36.

The bottom 36 and the cover section 38 are connected via a middle section 39, in particular the inner area of which is embodied so as to taper downwards in the direction of the cover section 38 in a funnel-shaped manner, and substantially serves as seal seat comprising a sealing zone 26 for the outlet valve 24.

Two annular walls 40 and 41, which run substantially concentrically to the longitudinal axis x, are integrally molded on the bottom side of the cover section 38. Said annular walls leave an annular space between each other for accommodating and supporting the collar 27 on the bellows side by means of clamp-mounting.

The radially outer annular wall 40 merges into the support section 18. Starting at the annular wall 40 and thus below the sealing zone 26 of the outlet valve 24, this support section 18 protrudes radially outwards in a circumferential manner in the direction of the inner wall of the cap part 32.

A substantially bell-like support section 18 comprising a bell opening, which is oriented downwards in the direction of the bottom 19, is thus formed.

In the illustrated exemplary embodiments, the outer annular wall 40 initially merges into a section, which widens outwards and on the bottom in the direction of the bottom 19 in a funnel-like manner and which supports a plate-like section on the end side for forming the bell shape. The support against the inner telescopic wall 10 of the cap part 32 occurs in the area of the circumferential outer wall of the plate section.

Starting at the annular wall 40, the support section 18 extends downwards to the free end across an axial length a, which corresponds approximately to half of the free pump chamber wall (zigzag wall) of the bellows part 13 (dimension b). Accordingly, the support section 18 of the support part 25 covers the bellows part 13 at least in its upper area, which faces the outlet valve 24. In a lowered position of the pup head 2 for dispensing substance 4, the support section 18 can also completely cover the corresponding bellows section.

Distancing walls 43, which are in each case oriented on a radial with respect to the longitudinal central axis x, are integrally molded on the support part 25 on the inner side of the accommodating section 42, which is formed by the annular walls 40 and 41, for accommodating the collar 27 of the bellows part 13. Starting at the bottom side of the cover section 38, which faces in the direction of the bottom 19, said distancing walls further extend in axial direction beyond the free edge of the radially inner annular wall 41 and thus dip into the pump chamber 12 or the bellows chamber, respectively.

In particular in the area, which projects beyond the annular wall 41, the distancing walls 43 have a radial extension, which corresponds approximately to 0.7 to 0.9-times the radius inside dimension of the bellows part 13 in the area of its zigzag wall.

In the exemplary embodiments, provision is made for four distancing walls 43, which are evenly distributed across the circumference, wherein each distancing wall extends radially outwards in circumferential direction across an angle $\alpha$ of between approximately 60 and 70°. According to the second embodiment illustrated in FIGS. 5 to 7, an angle of approximately 45° can also be reached here.

On the inner side, the distancing walls 43 merge into an annular structure 44. The latter is oriented concentrically to the longitudinal central axis x.

The annular structure 44 serves to accommodate a foot area 45 of the outlet valve 24. The foot area 45 hereby permeates an opening 46, which is defined circumferentially by the middle section 39 and which permeates the cover section 38.

Assigned to their free lower ends, the distancing walls 43 support a closing part 47, which is oriented at right angles to the longitudinal central axis x. Said closing part is connected to the annular structure 44 via webs 48.

The substance 4 flows around the closing part 47 and preferably around the annular structure 44 when dispensing.

Facing away from the pump chamber 12, the channel section of the support part 25 merges into the dispensing channel 29 with its dispensing opening 34.

The inlet valve 14, which spans the opening 20 in the bottom 19 in a bridge-like manner, is connected to the bellows part 13 by means of support arms 30, which extend in circumferential direction of the inlet valve 14.

Figure 5:
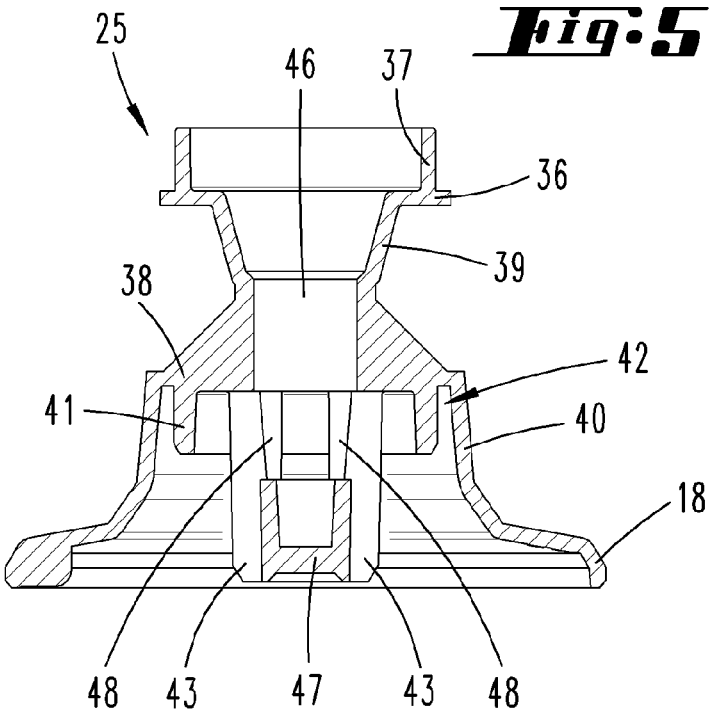
FIG. 5 shows an illustration, which corresponds to FIG. 2, relating to a second embodiment of the support part.
Figure 6:
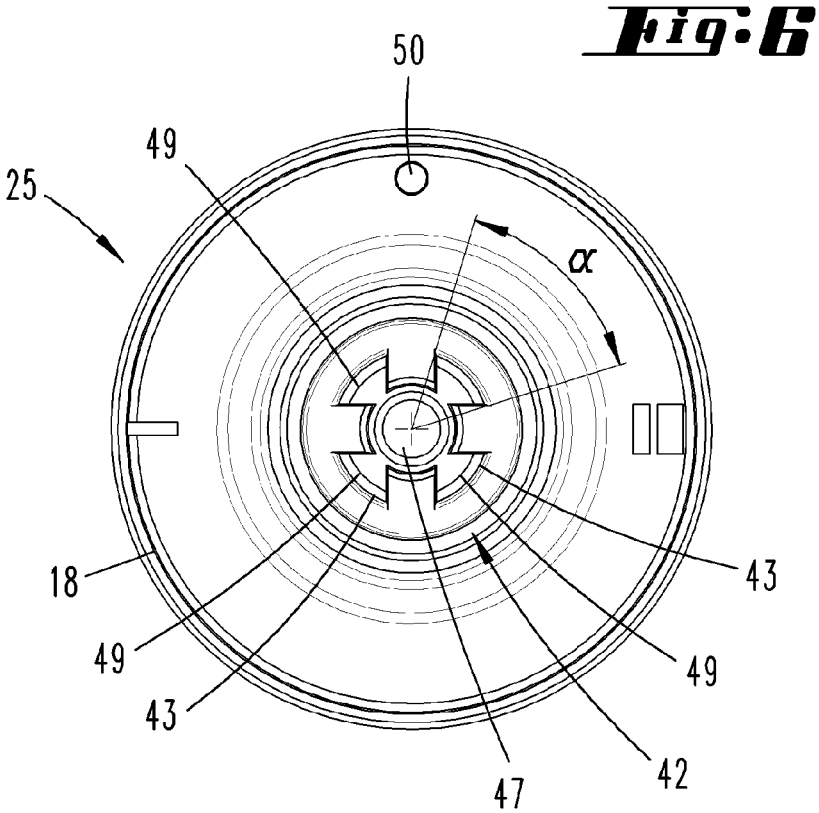
FIG. 6 shows the bottom view for this.
Figure 7:
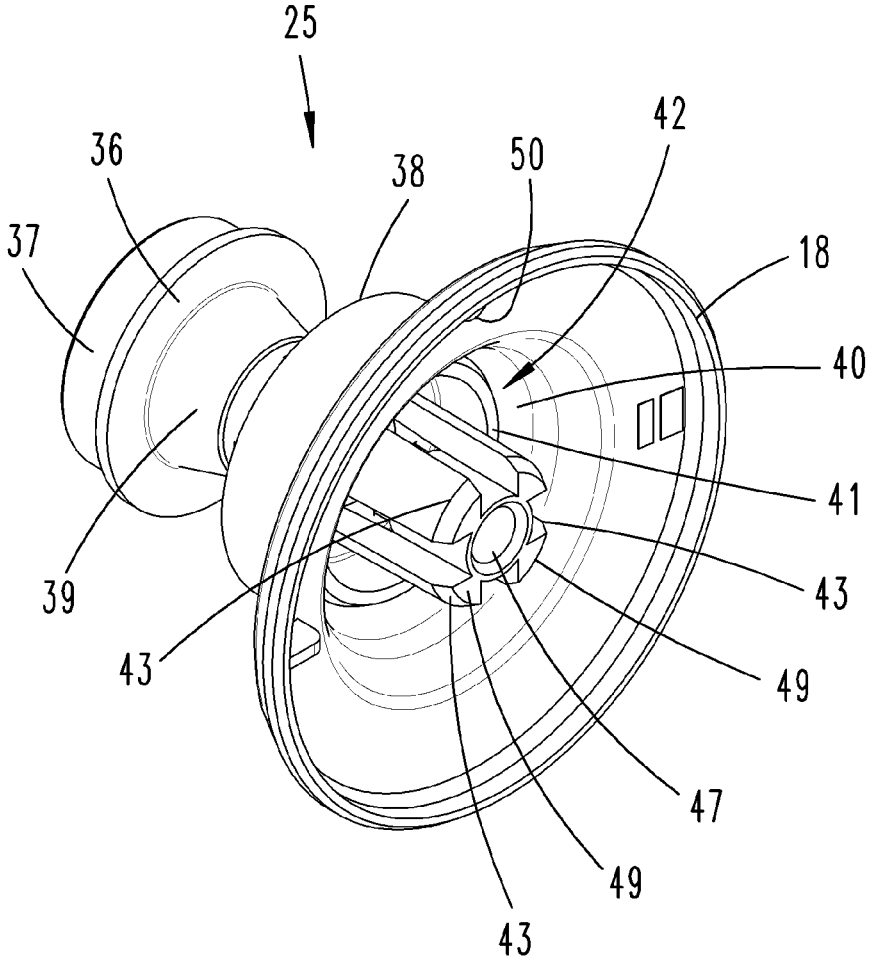
FIG. 7 shows a perspective illustration of the support part of the second embodiment.

As can further be seen in the second embodiment illustrated in FIGS. 5 to 7, stabilizing webs 49 can be integrally molded on the outer wall side of the middle section 39. Said stabilizing webs in each case preferably have a triangular layout and are connected along one journal on the outer wall side of the middle section 39 and along a further journal on the top side of the cover section 38. Provision is preferably made for four such stabilizing webs 49, which are distributed evenly across the circumference.

Provision can also be made for a relief opening 50 for pressure compensation in the area of the support section 18.

The above explanations serve to explain the inventions, which are captured as a whole by the application, which in each case also further develop the prior art independently, at least by means of the following feature combinations, namely:

A dispenser, which is characterized in that the support on the inner surface of the cap part 32 is formed by means of a support section 18 of the support part 25, which protrudes below the sealing zone and which simultaneously forms an accommodation for the upper free edge of the bellows part 13 in a one-part embodiment with an accommodating section 42.

A dispenser, which is characterized in that, viewed from the top, the support section 18 extends across a third or more of the free pump chamber wall.

A dispenser, which is characterized in that the support section 18 is bellmouthed at least in the lower area.

A dispenser, which is characterized in that distancing walls 43, which orient themselves on a radial with regard to a longitudinal central axis x of the pump chamber 12, can connect to the inner side of the accommodating section 42.

A dispenser, which is characterized in that, on the inner side, one or a plurality of distancing walls 43 transition into an annular structure 44, which accommodate a foot area 45 of the outlet valve 24.

A dispenser, which is characterized in that, assigned to their lower free ends, one or a plurality of distancing walls 43 support a closing part 47, around which the substance 4 flows when dispensing.

A dispenser, which is characterized in that a distancing wall 43 extends radially outside in circumferential direction across an angle $\alpha$ of between 20 and 70°.

All of the disclosed features (alone, but also in combination with one another) are relevant for the invention. The disclosure content of the corresponding/enclosed priority documents (copy of the earlier application) is hereby also included in its entirety in the disclosure of the application, also for the purpose of adding features of these documents into claims of the instant application. The features of the subclaims characterize independent inventive further developments of the prior art, in particular for filing divisional applications on the basis of these claims.

| List of Reference Numerals | |
|---|---|
| 1 | dispenser |
| 2 | pump head |
| 3 | storage container |
| 4 | substance |
| 5 | adapter part |
| 6 | cap |
| 7 | annular shoulder |
| 8 | outer telescopic part |
| 9 | inner telescopic part |
| 10 | inner telescopic wall |
| 11 | outer telescopic wall |
| 12 | pump chamber |
| 13 | bellows part |
| 14 | inlet valve |
| 15 | valve seat |
| 16 | support base |
| 17 | annular shoulder |
| 18 | support section |
| 19 | bottom |
| 20 | opening |
| 21 | ring |
| 22 | ring |
| 23 | valve lip |
| 24 | outlet valve |
| 25 | support part |
| 26 | sealing zone |
| 27 | collar |
| 28 | |
| 29 | dispensing channel |
| 30 | support arm |
| 31 | |
| 32 | cap part |
| 33 | actuating surface |
| 34 | dispensing opening |
| 35 | support projection |
| 36 | bottom |
| 37 | wall |
| 38 | cover section |
| 39 | middle section |
| 40 | annular wall |
| 41 | annular wall |
| 42 | accommodating section |
| 43 | distancing wall |
| 44 | annular structure |
| 45 | foot area |
| 46 | opening |
| 47 | closing part |
| 48 | web |
| 49 | stabilizing web |

-continued

| List of Reference Numerals | |
|---|---|
| 50 | relief opening |
| a | length |
| b | length |
| x | longitudinal central axis |
| α | angle |

The invention claimed is:

1. A dispenser (1) for dispensing liquid to pasty substances (4), comprising a pump head (2), a cap part (32), which has a dispensing opening (34), and a pump chamber (12), which is embodied in the pump head (2), has a pump chamber wall and has an outlet valve (24), further comprising a support part (25), which accommodates the outlet valve (24), wherein the support part (25) sits in the cap part (32) and is supported on an inner surface of the cap part (32), wherein the pump chamber (12) is further formed by a bellows part (13), an upper free edge of which is arranged so as to be assigned to the support part (25), and wherein the outlet valve (24) rests against the support part (25) in a sealing zone, wherein a support on the inner surface of the cap part (32) is formed by means of a support section (18) of the support part (25), which protrudes below the sealing zone and which simultaneously forms an accommodation for the upper free edge of the bellows part (13) in a one-part embodiment with an accommodating section (42), wherein lower free ends of one or a plurality of distancing walls (43) support a closing part (47), around which the substance (4) flows when dispensing.

2. The dispenser (1) according to claim 1, wherein the accommodating section (42) has annular walls (40, 41) that run substantially concentrically to a longitudinal axis (x) and are integrally molded on a bottom side of a cover section (38), said annular walls leaving an annular space between each other for accommodating and supporting a collar (27) of the bellows part (13) by clamp-mounting.

3. The dispenser according to claim 2, wherein, viewed from the top, the support section (18) extends across a third or more of a free pump chamber wall.

4. The dispenser according to claim 2, wherein the support section (18) is bellmouthed at least in the lower area.

5. The dispenser according to claim 2, wherein distancing walls (43), which orient themselves on a radial with regard to a longitudinal central axis (x) of the pump chamber (12), connect to an inner side of the accommodating section (42).

6. The dispenser according to claim 2, wherein, on an inner side, one or a plurality of distancing walls (43) transition into an annular structure (44), which accommodate a foot area (45) of the outlet valve (24).

7. The dispenser according to claim 2, wherein an outside of a distancing wall (43) extends radially in circumferential direction across an angle (α) of between 20 and 70°.

* * * * *